US005078103A

United States Patent [19]

Bahm et al.

[11] Patent Number: 5,078,103

[45] Date of Patent: Jan. 7, 1992

[54] IGNITION DISTRIBUTOR FOR INTERNAL COMBUSTION ENGINES

[75] Inventors: Klaus Bahm, Kraichtal-Menzingen; Roland Michal, Pforzheim; Horst Behnke, Esslingen, all of Fed. Rep. of Germany

[73] Assignees: Doduco GmbH & Co., Pforzheim; Mercedes-Benz Aktiengesellschaft, Stuttgart, both of Fed. Rep. of Germany

[21] Appl. No.: 626,835

[22] Filed: Dec. 13, 1990

[30] Foreign Application Priority Data

Dec. 14, 1989 [DE] Fed. Rep. of Germany ..... 3941284

[51] Int. Cl.[5] ..... F02D 1/00

[52] U.S. Cl. ..... 123/146.5 A; 200/19 DC

[58] Field of Search ..... 123/146.5 A, 633; 200/19 DC

[56] References Cited

U.S. PATENT DOCUMENTS

| | | | |
|---|---|---|---|
| 1,699,829 | 1/1929 | Barthey | 200/190 C |
| 2,006,341 | 8/1935 | Berg et al. | 200/19 DC |
| 2,464,533 | 3/1949 | Shearer | 200/19 DC |
| 4,129,107 | 12/1978 | Boyer | 123/146.5 A |
| 4,153,030 | 5/1979 | Power et al. | 123/146.5 A |
| 4,164,912 | 8/1979 | Beyler | 123/146.5 A |
| 4,529,850 | 7/1985 | Brammer et al. | 123/146.5 A |
| 4,577,610 | 3/1986 | Schwartz | 123/146.5 A |
| 4,887,572 | 12/1989 | Kodama et al. | 123/146.5 A |
| 4,903,673 | 2/1990 | Chiba et al. | 123/146.5 A |
| 4,941,450 | 7/1990 | Matsumara et al. | 123/146.5 A |

*Primary Examiner*—Raymond A. Nelli
*Attorney, Agent, or Firm*—Dvorak and Traub

[57] ABSTRACT

The distributor comprises a rotatably mounted rotor, which has close to its axis of rotation a first electrode and has at its end that is remote from the axis of rotation a second electrode, which is connected by an electric line to the first electrode. The distributor also comprises a housing, which is closed by a cap, which is provided on its inside peripheral surface with a plurality of peripherally spaced apart fixed electrodes for cooperating with the second electrode of the roto. The cap is further provided on its inside surface with a center electrode, which terminates at a distance from the first electrode of the rotor to form a spark gap therewith. To form a positive joint with the cap the embedded portion of the center electrode has a non-cylindrical peripheral surface, which is rounded and free of any edge.

7 Claims, 2 Drawing Sheets

IGNITION DISTRIBUTOR FOR INTERNAL COMBUSTION ENGINES

BACKGROUND OF THE INVENTION

1. Field of the Invention

This invention relates to an ignition distributor for internal combustion engines, comprising a housing, in which a rotor of the distributor is rotatably mounted, which is provided near its axis of rotation with a first electrode and at an end that is remote from its axis of rotation with a second electrode and comprises an electric line connecting the two electrodes, and a distributor cap, which closes the housing and is provided on its inside surface with a plurality of peripherally spaced apart fixed electrodes for cooperating with the second electrode of the rotor, and with a center electrode, wherein said fixed electrodes and center electrode are embedded in said cap and said center electrode terminates at a distance from the first electrode of the rotor to define a spark gap with said first electrode. The center electrode has a portion which is embedded in said cap, and said embedded portion has a non-cylindrical peripheral surface for establishing a positive joint with said cap.

2. Description of the Prior Art

In modern internal combustion engines the ignition distributor is directly mounted on the engine block, which thus constitutes the base part of the distributor housing, in which the rotor of the distributor is rotatably mounted. The top part of the distributor housing usually consists of a cap, which is made of a synthetic resin, usually a polyester or epoxide resin. That distributor cap carries on its inside surface a plurality of peripherally spaced apart, fixed electrodes and a center electrode, from which the igniting voltage is applied to the electrode of the rotor so that a flashover is effected from the rotor electrode through a spark gap to the fixed electrodes.

Because the distributor is mounted directly on the engine block the distributor is exposed in operation to a high temperature of about 130° C. and all elements of the distributor must withstand that temperature in long-time operation. The fact that the high operating temperature has undesired consequences has become apparent when the center electrode of the distributor cap initially consisted of a sliding carbon electrode, which was resiliently urged against the confronting electrode of the rotor, in the arrangement which is usual in distributors that are spaced from the engine block. It has been found that the sliding carbon electrode is liable to break at the high operating temperatures. For this reason it has been proposed in DE-37 43 940 A1 to provide a distributor which is of the kind described first hereinbefore and in which the igniting voltage is applied to the rotor of the distributor via a spark gap that is provided between the rotor and the cap rather than via a sliding contact. In that case the center electrode may be fixedly embedded in the cap of the distributor and may be made of metal. Whereas the need for sliding carbon electrodes which are liable to break is thus eliminated, new problems will arise. If the voltage between the center electrode and the electrode of the rotor is about 35 kV, the sparks between said electrodes will result in a considerable stress on the electrodes and on the plastic material in which the electrodes are embedded. Each spark discharge will release energy, by which the electrodes and the surrounding plastic material are heated. At the same time chemically reactive compounds are formed in the ignition distributor atmosphere. Spark discharges will also occur between the rotor and the fixed electrodes because a spark gap for applying the igniting voltage has always been provided there. But that fact has not given rise to problems regarding the fixed electrodes in the past because a spark discharge occurs at said fixed electrodes only once in each revolution of the rotor. On the other hand, there are a plurality of spark discharges—equal in number to the cylinders of the engine—at the center electrode during each revolution of the rotor so that the wear of the center electrode of the distributor cap will be a multiple of the wear of the fixed electrodes. This is aggravated by the fact that a distributor which is directly mounted on the engine block will always be at a high temperature during operation and that the plastic material of which the cap is made is stressed at the same time by a high voltage up to 35 kilovolts. As a result, cracks will be formed in the plastic material which surrounds the center electrode and will become visible after a travel of about 10,000 kilometers. The cracks will become wider and deeper thereafter and portions of the plastic material may crumble and break out of the cap. In order to avoid such results it has been proposed by the makers of motor vehicles that the cap and the rotor of the distributor should be replaced after a travel of 10,000 km although this involves higher servicing costs.

SUMMARY OF THE INVENTION

It is an object of the invention to provide an ignition distributor which is of the kind described first hereinbefore and which is inexpensive and has a long service life.

In an ignition distributor which is of the kind described first hereinbefore that object is accomplished in accordance with the invention in that the embedded portion of the center electrode has a non-cylindrical peripheral surface which is rounded and free of any edge.

Further features of the invention will be recited in the dependent claims.

In known distributors the center electrode has been embedded in the distributor cap with formation of a positive joint and the center electrode has been locked against a longitudinal displacement and against a rotation in that the peripheral surface of the center electrode was turned by a lathe to form shoulders and was milled on one side to have a non-circular contour. That practice resulted in a formation of edges, which are avoided in accordance with the invention so that the cap of the distributor has a much longer service life. It is apparent from that result that in the known distributors the formation of cracks resulting from the combined thermal and electrical stresses on the center electrode has been initiated at the edges which were embedded in the synthetic resin of the cap of the distributor and that the avoiding of said edges is essential for the result produced by the invention. The cost of the distributor is only slightly increased by the use of a rounded center electrode and owing to the much longer service life of the distributor the use of such center electrode will greatly reduce the distributor costs which are accumulated during the life of the motor vehicle in operation, as is even more important for the driver in most cases. In contrast to the center electrode the fixed electrodes at the periphery of the cap do not need to be rounded like the center electrode but it is better if they are provided with edges in their embedded portion.

In order to ensure that the gain in service life will be sufficiently large it is recommended that the embedded surface portions should have a radius of curvature in excess of 0.5 mm, preferably in excess of 1 mm. In trial operations a life corresponding to a travel of 100,000 km has been achieved with surface portions having a radius of curvature in excess of 1 mm. Surface portions having such radii of curvatures will not be regarded as edges for the purposes of the invention.

In order to ensure that the center electrode will be held against longitudinal displacement, its peripheral surface must have in longitudinal section a non-rectangular configuration. To hold the center electrode against rotation it must have a non-circular shape in cross-section. The deviations from the rectangular and circular configurations must be constituted by curved surface portions. As a result, the center electrode has a bulge and/or a waist and has a non-circular, preferably oval shape in cross-section at least over a part of the length of its embedded portion.

DETAILED DESCRIPTION OF THE PREFERRED EMBODIMENT

An illustrative embodiment of the invention will now be described more in detail with reference to the accompanying drawing.

Figure 1:
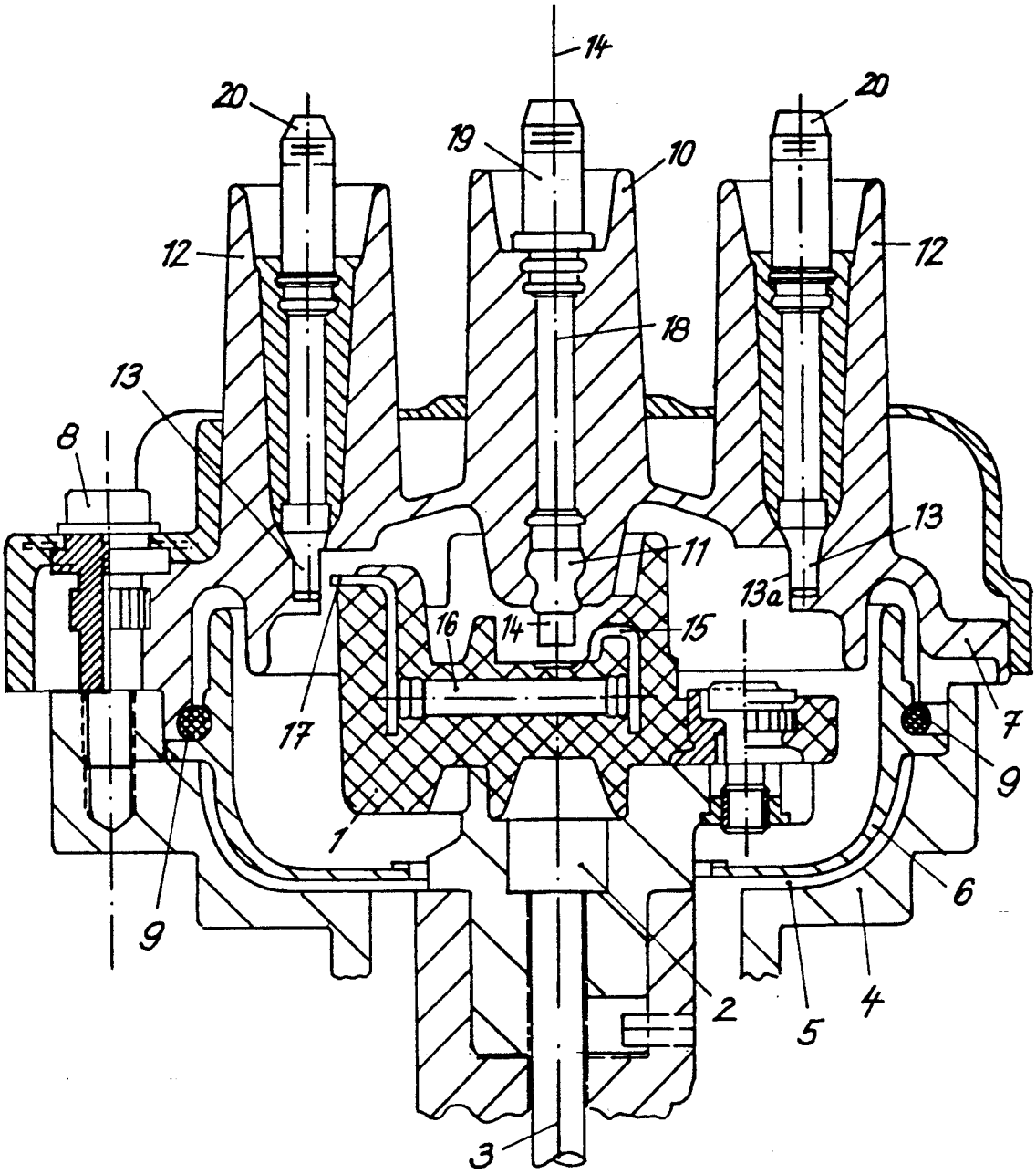
FIG. 1 is a longitudinal sectional view showing an ignition distributor.

The ignition distributor shown in FIG. 1 comprises a rotor 1, which is secured to a head 2 of a camshaft 3 of an internal combustion engine. That portion of the engine block 4 which surrounds the head 2 of the camshaft 3 constitutes a part of the housing of the distributor and to that end is formed with a shallow recess 5, into which a housing pan 6 made of synthetic resin has been inserted. The housing of the distributor is closed by a cap 7, which is fixed by screws 8 to the engine block 4 and overlaps the rim of the pan 6 so that the latter is fixed. The interior of the distributor is sealed by a sealing ring 9 provided between the cap 7 and the pan 6.

The cap of the distributor is formed with a central dome 10, which contains a center electrode 11. The cap is also formed with outer domes 12, which are equal in number to the cylinders of the internal combustion engine and contain respective fixed electrodes 13, each of which has on the inside of the cap a surface **13*a* which faces the longitudinal center line 14** of the distributor.

The center electrode 11 has a cylindrical extension **11*a*, which extends to a first electrode 15 of the rotor 1 of the distributor. A spark gap is constituted by a narrow air gap left between the cylindrical portion 11*a* of the center electrode and the first electrode 15 of the rotor 1. The first electrode 15 is connected to a second electrode 17 of the rotor 1 by an electric lead, which may incorporate an interference-suppressing resistor 16. The second electrode 17 is provided on the rotor 1 at that end thereof which is remote from the axis 14. During a rotation of the rotor 1 the second electrode 17 moves past the surfaces 13*a* of the fixed electrodes 13** so that spark gaps are formed there too.

The center electrode 11 is connected to a resistor 18, which is embedded in the central dome 10 and is connected to an electric contact element 19. The fixed electrodes 13 are provided with similar contact elements 20. The contact elements 19 and 20 serve to receive electric plugs.

Figure 2:
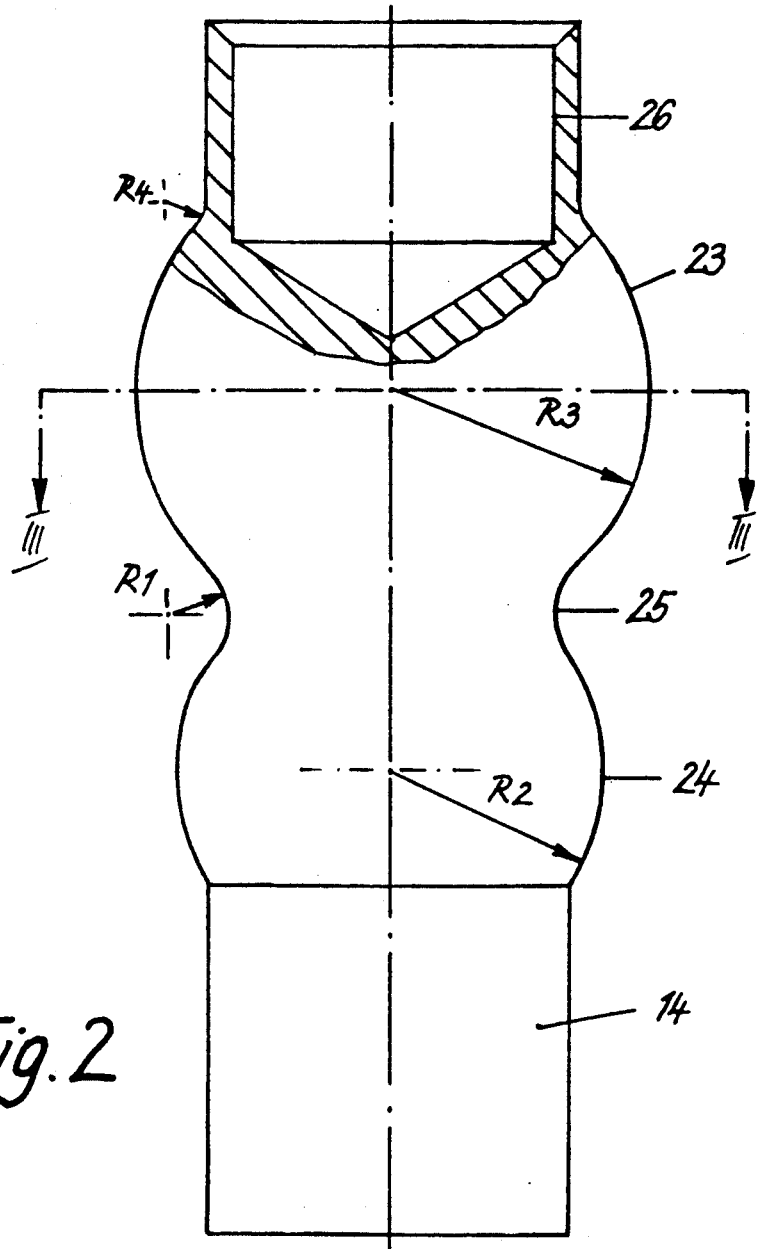
FIG. 2 is a side elevation showing partly in section on a larger scale as a detail the center electrode of the cap of the distributor.
Figure 3:
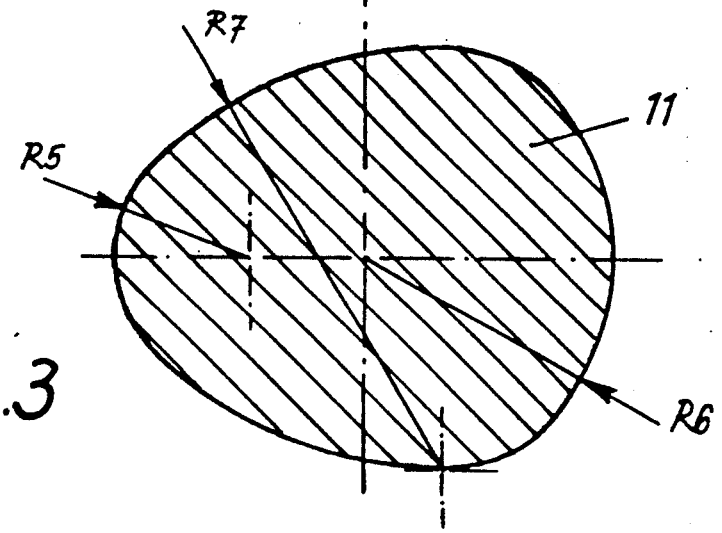
FIG. 3 is a transverse sectional view taken on line III—III in FIG. 2.

To ensure that the center electrode cannot rotate and cannot longitudinally be displaced in the cap 7, which is made of synthetic resin, the center electrode is embedded in the synthetic resin with a positive joint, which is provided in that the embedded portion of the center electrode has a non-cylindrical peripheral surface, the shape of which is apparent from FIGS. 2 and 3.

The center electrode 11 comprises a portion 22, which is embedded in the synthetic resin of the cap, and a cylindrical portion **11*a*, which protrudes from the synthetic resin. The embedded portion 22 comprises two bulges 23 and 24, a waist 25, which is disposed between said bulges, and a hollow-cylindrical portion 26, into which one end of the resistor 18** has been inserted.

With the exception of the thicker bulge 23, which has an oval shape in cross-section, the peripheral surface of the center electrode 11 has the shape of a circular cylinder.

A numerical example will now be reported:

| | |
|---|---|
| Diameter of cylindrical portion 14: | 4.4 mm |
| Largest diameter of small bulge 24: | 5.75 mm |
| Smallest diameter of waist 25: | 4.4 mm |
| Largest diameter of large bulge 23: | 6.95 mm |
| Outside diameter of hollow-cylindrical portion 26: | 5.1 mm |
| Radius of curvature R1 of waist: | mm |
| Radius of curvature R2 of small bulge 24: | 2.5 mm |
| Radius of curvature R3 of large bulge 23: | 3.5 mm |
| Radius of curvature R4 at the transition from the large bulge 23 to the hollow-cylindrical portion 26: | mm |

The oval cross-section of the center electrode 11 shown in FIG. 3 is defined in this example by the following radii of curvature:

| | |
|---|---|
| Portion having the smallest radius R5 = | 1.73 mm |
| Opposite thereto, a portion having the radius R6 = | 3.5 mm |
| The portions connecting the two portions mentioned first have a radius of curvature R7 = | 6.1 mm |

The additional electrodes 13, 15, 17 of the distributor may be correspondingly rounded in the portions with which they are embedded in synthetic resin but this is not essential because said additional electrodes are not so highly stressed as the center electrode 11.

We claim:

1. In an ignition distributor for internal combustion engines, comprising housing means, a rotor mounted in said housing means for rotation about an axis and having an outer end remote from said axis, which rotor is provided near said axis with a first electrode and at said outer end with a second electrode, which is electrically conductively connected to said first electrode, and a cap, which closes said housing means and has an inside surface facing said rotor and is provided on said inside surface with a plurality of peripherally spaced apart fixed electrodes, which are embedded in said cap and adapted to cooperate with said second electrode, said cap being also provided on said inside surface with a center electrode, which terminates at a distance from said first electrode to define a spark gap therewith and comprises an embedded portion, which is positively embedded in said cap and to effect this it has a non-cylindrical peripheral surface, the improvement residing in that said non-cylindrical peripheral surface in said embedded portion is rounded and is free of edges.

2. The improvement set forth in claim 1, wherein said non-cylindrical peripheral surface in said embedded portion is free of surface portions having a radius of curvature which is not in excess of 0.5 mm.

3. The improvement set forth in claim 1, wherein said non-cylindrical peripheral surface in said embedded portion is free of surface portions having a radius of curvature which is not in excess of 1 mm.

4. The improvement set forth in claim 1, wherein said non-cylindrical peripheral surface of said embedded portion has in longitudinal section a non-rectangular configuration and has in cross-section a non-circular configuration.

5. The improvement set forth in claim 1, wherein said embedded portion has an oval shape in cross-section at least in part of its length.

6. The improvement set forth in claim 1, wherein said fixed electrodes are provided with edges in a portion, with which they are embedded in said cap.

7. The use of a center electrode which is positively embedded with a non-cylindrical portion of its peripheral surface in the cap of an ignition distributor for internal combustion engines and which is rounded avoiding any edges in said portion in order to prevent the formation of cracks or fissures in said cap due to a combined thermal and electrical impact on said cap of such an ignition distributor which is to be mounted directly on the engine block and in which the center electrode terminates at a distance from its opposite electrode at the ignition distributor rotor thereby forming a spark gap between said center electrode and said opposite electrode.

* * * * *